US007990279B2

(12) United States Patent
Bouressa

(10) Patent No.: US 7,990,279 B2
(45) Date of Patent: Aug. 2, 2011

(54) EMERGENCY INGRESS/EGRESS MONITORING SYSTEM

(76) Inventor: Don L. Bouressa, Simpsonville, SC (US)

( * ) Notice: Subject to any disclaimer, the term of this patent is extended or adjusted under 35 U.S.C. 154(b) by 387 days.

(21) Appl. No.: 12/290,923

(22) Filed: Nov. 5, 2008

(65) Prior Publication Data

US 2009/0079575 A1 Mar. 26, 2009

Related U.S. Application Data

(63) Continuation-in-part of application No. 10/719,719, filed on Nov. 21, 2003, now Pat. No. 7,468,658.

(60) Provisional application No. 60/440,194, filed on Jan. 15, 2003.

(51) Int. Cl.
*G08B 3/00* (2006.01)

(52) U.S. Cl. ..... 340/691.1; 340/539.11; 340/825.36

(58) Field of Classification Search ..... 340/539.1, 340/539.11, 539.13, 825.36, 825.49, 539.21, 340/539.23, 539.32, 691.1
See application file for complete search history.

(56) References Cited

U.S. PATENT DOCUMENTS

| | | | | |
|---|---|---|---|---|
| 3,794,765 | A | 2/1974 | Goodwater | |
| 5,204,670 | A | 4/1993 | Stinton | |
| 5,218,344 | A | 6/1993 | Ricketts | |
| 5,596,652 | A | 1/1997 | Piaket | |
| 5,633,621 | A | 5/1997 | McDonald | |
| 5,745,037 | A | 4/1998 | Guthrie | |
| 5,960,085 | A | 9/1999 | de la Huerga | |
| 6,185,848 | B1 | 2/2001 | Chmiels | |
| 6,211,781 | B1 | 4/2001 | McDonald | |
| 6,348,860 | B1 * | 2/2002 | Davis et al. | 340/525 |
| 6,356,841 | B1 | 3/2002 | Hamrick et al. | |
| 6,373,389 | B1 * | 4/2002 | Przygoda et al. | 340/572.4 |
| 6,394,356 | B1 * | 5/2002 | Zagami | 235/487 |
| 7,286,158 | B1 * | 10/2007 | Griebenow | 348/156 |
| 7,468,658 | B2 * | 12/2008 | Bouressa | 340/539.1 |
| 2002/0071033 | A1 * | 6/2002 | Gutta et al. | 348/143 |
| 2002/0149467 | A1 * | 10/2002 | Calvesio et al. | 340/5.52 |
| 2002/0167403 | A1 * | 11/2002 | Colmenarez et al. | 340/541 |

* cited by examiner

*Primary Examiner* — Daniel Previl
(74) *Attorney, Agent, or Firm* — Stephen R. Chapman

(57) ABSTRACT

A system to monitor the entry and exit of individuals from a facility and to identify individuals who safely evacuated the facility and those who have entered, but apparently have not safely evacuated it and indicated safe evacuation by use of a card reader or similar device at an emergency reporting area. The system also indicates the most likely area of a facility in which an individual may be found. Such census information is made available to emergency workers and is of significant value in rescue efforts following facility evacuations. A modification of the systems allows an attendant to monitor the entry, exit, and re-entry of individuals traveling in two or more vehicles following stops. Finally, the system includes a head count census of individuals entering large facilities in which individual identity is effectively impossible to follow and a head count census of individuals evacuating the facility identified by specific parts of the facility.

5 Claims, 10 Drawing Sheets

EMERGENCY INGRESS/EGRESS MONITORING SYSTEM

This patent application is a Continuation-in-Part of U.S. patent application Ser. No. 10/719,719 filed Nov. 21, 2003 now U.S. Pat. No. 7,468,658 and claims benefit and priority of that application which hereby is incorporated in its entirety and through U.S. Ser. No. 10/719,719 also claims U.S. provisional application 60/440,194 filed Jan. 15, 2003 and claimed by U.S. Ser. No. 10/719,719.

FIELD OF THE INVENTION

The present invention relates to a communication system and method to monitor the ingress and egress of individuals to and from various types of facilities. It also provides emergency workers with information as to the most likely location of individuals not having evacuated the facility or who may need special assistance.

BACKGROUND OF THE INVENTION

The size and complexity of many facilities and increased possibility of an emergency evacuation from such facilities suggest benefits of a simple system to monitor occupancy of the facility, such that emergency workers can determine rapidly the status of evacuation, and have a reasonable indication where in the facility an individual not reported as having evacuated the facility might be located. In non-emergency situations, such a system provides a census of occupancy, and for vehicles, such as school busses, the system indicates individuals boarding and exiting the vehicle, and re-boarding after stops, such as after a field trip. Such monitoring systems improve safety and simplify certain supervisory responsibilities of organizations with in loco parentis responsibilities.

Wireless means have been described to assist in the evacuation of non-ambulatory individuals from a fixed structure. U.S. Pat. No. 5,633,621 issued May 27, 1997 to McDonald describes a system whereby a non-ambulatory individual may enter confidential information including name, destination in the facility, and the nature or extent of disability into a building monitoring system. Rescue workers may access such information and determine the location of individuals that may require special assistance.

U.S. Pat. No. 6,348,860 issued Feb. 19, 2002 to Davis and Shock describes an evacuation monitoring system in which evacuation wardens visually inspect designated areas and evacuation routes from a given area and activate a reporting system at a remote location to indicate the status of each inspected area.

Tag tracking affords an additional means to track articles, including individuals. U.S. Pat. No. 6,211,781 issued Apr. 3, 2001 to McDonald describes a device and method of tracking articles within a facility using electronic signals.

Thus, there remains room and need for the development of a system to monitor ingress/egress of facilities.

SUMMARY OF THE INVENTION

Protecting life is the primary objective of emergency rescue efforts. Protecting property is a secondary. The monitoring system of this invention increases the efficiency and effectiveness of emergency workers' efforts to protect human life by providing information essential to allocation of search and rescue resources.

A purpose of the invention is a communication system to monitor the ingress of individuals to a facility and in the event of an emergency evacuation, by wired, or wireless means to monitor and record the safe evacuation (egress) and location of individuals from the facility to an emergency assembly area.

A further purpose of the invention is to rapidly identify individuals whose entry into the facility has been recorded, but, for whom no record of safe exit has been made and to indicate to the most likely location in the facility to find the individual.

An additional purpose of the invention is to monitor and record the identification, entry, and destination of visitors to the facility for security reasons as well as for monitoring an emergency evacuation from the facility.

Another purpose of the invention is to provide to rescue workers by electronic means diagrams of structures from which the location of trapped individuals can be high-lighted and evacuation routes and alternatives can be formulated.

An additional purpose of the invention is flexibility and simplicity of growth or expansion of the system.

And yet another purpose of the invention is to provide a mobile or portable system to assist supervisors acting potentially for an institution in loco parentis in monitoring ingress of individuals to one or more vehicles, subsequent egress of individuals at the site of an activity, and reentry to any one of the vehicles for return to the school or other facility.

A further purpose of the system is to monitor the evacuation of relatively large numbers of individuals grouped in a confined area, such as passengers on a cruise ship.

Yet another purpose of the invention is a system to monitor normal ingress into/emergency egress from a large entertainment or similar facility or area based on head count of individuals entering specific areas of the facility and providing continuously generated head count occupancy census for individual locations and total occupancy by deleting egress head count from a final ingress head count and reporting the census and other information in various display formats, including hard copy and computer display to emergency workers.

These and other goals and purposes of the invention are achieved by an evacuation monitoring system wherein first identification reader means at points of entry communicate ingress/egress data, including the destination of individuals entering the facility to a base computer that maintains the census of facility occupants and their location in the facility, and from time to time, under normal operating conditions, transmits the census to a second computer, such that when the evacuation system is activated, the base computer and all other components of the system switch to independent power supplies and all ingress data or have been communicated by wireless means to a second, portable computer which is connected by wireless means to at least one second card reader means located at a designated emergency assembly area and which transmits by wireless means presence of an individual at the assembly area by reading a card identifying the individual, thereby allowing the portable computer to generate and provide a census of individuals remaining in the facility and provide a probable location for each, and in addition, at the onset of emergency operations, the first card reader means is activated such that the first card reader means communicates with the portable computer so that individuals whose egress is entered by way of this unit are also deleted from the occupancy census record, and finally, also by a system associated with a facility comprising one or more elements with a card reader device in each of one or more elements of the facility from which entry, exit, and subsequent re-entry is monitored by the specific reader device associated with each element of the facility in which an element of the facility is one of a group of vehicles, and further in which each card reader device communicates entry, exit, and re-entry data to a computer, wherein the computer is capable of producing an immediate record of all individuals initially entering any element of the facility, exiting an element of the facility, and warning an attendant if all individuals exiting an element of the facility have not re-entered some element of the facility, and a final head count census generated from head count monitored/scored by a variety of available counting devices (including devices that recognize physiognomic characteristics) located at established entrances to specific seating areas at which emergency egress is also scored by head count and additionally, emergency egress head count is also scored at designated emergency exits and exit only doors and gates serving the specific seating area such that a final ingress head count is generated as a data file and emergency egress census for the facility and for specific areas is constantly generated from the final ingress data; video capabilities allow monitoring of evacuation along evacuation corridors and established routes and voice communications for exchanging emergency information.

BRIEF DESCRIPTION OF THE FIGURES

The numerous purposes, applications, and advantages of the present invention may be better and more clearly understood by reference to the following figures in which reference numbers regardless of the figure in which they might appear, refer to the same part or feature as the reference number initially is used and in which.

DESCRIPTION OF THE PREFERRED EMBODIMENTS

The emergency ingress/egress monitoring system 1 is well adapted to facilities with designated offices or work stations and most individuals located at a specific, designated location or work station. Such facilities include, but not limitation, office buildings, hospitals, schools, factories, and entertainment facilities and arenas, as well as monitoring passengers leaving and returning to bus, train, aircraft, or vessel and individuals reporting to emergency or evacuation centers or shelters.

The emergency ingress/egress monitoring system regardless of any specific application or adaptation may require a source of personal identification capable of being read by a card reader means located at the point of ingress, a base computer and a means, preferably wireless, to communicate the individual data to a base computer, a portable computer in, preferably, wireless communication with the base computer, and a second card reader means, in preferably wireless, communication to input personal identification data to the portable computer. Input of personal data to the base computer indicates ingress to a facility, and input to the portable computer in the event of an emergency indicates egress from the facility and the location of the individual.

Many commonly used items may be adapted to serve as the required source of personal information data. Examples include, but are not limited to magnetic strips on employee identification cards, bar codes on identification cards, or separate cards, and magnetic room keys with specific identification information. The means to read any of these include a plurality of forms of the common card "swipe readers" or parallel devices that read magnetic keys. The invention also anticipate more sophisticated means of personal recognition/personal data entry including voice recognition and recognition of physical traits.

The source of personal information data may include minimum information (name), with other data independently stored in the base computer and automatically referenced by the name, personal data input may include all information essential for rescuers, such as office duty station and the need for special assistance.

The system also includes capabilities to monitor guests or visitors to the facility. The invention anticipates that data for guest would include information that would automatically indicate the most likely location of the visitor in the facility.

Example 1

Figure 1:
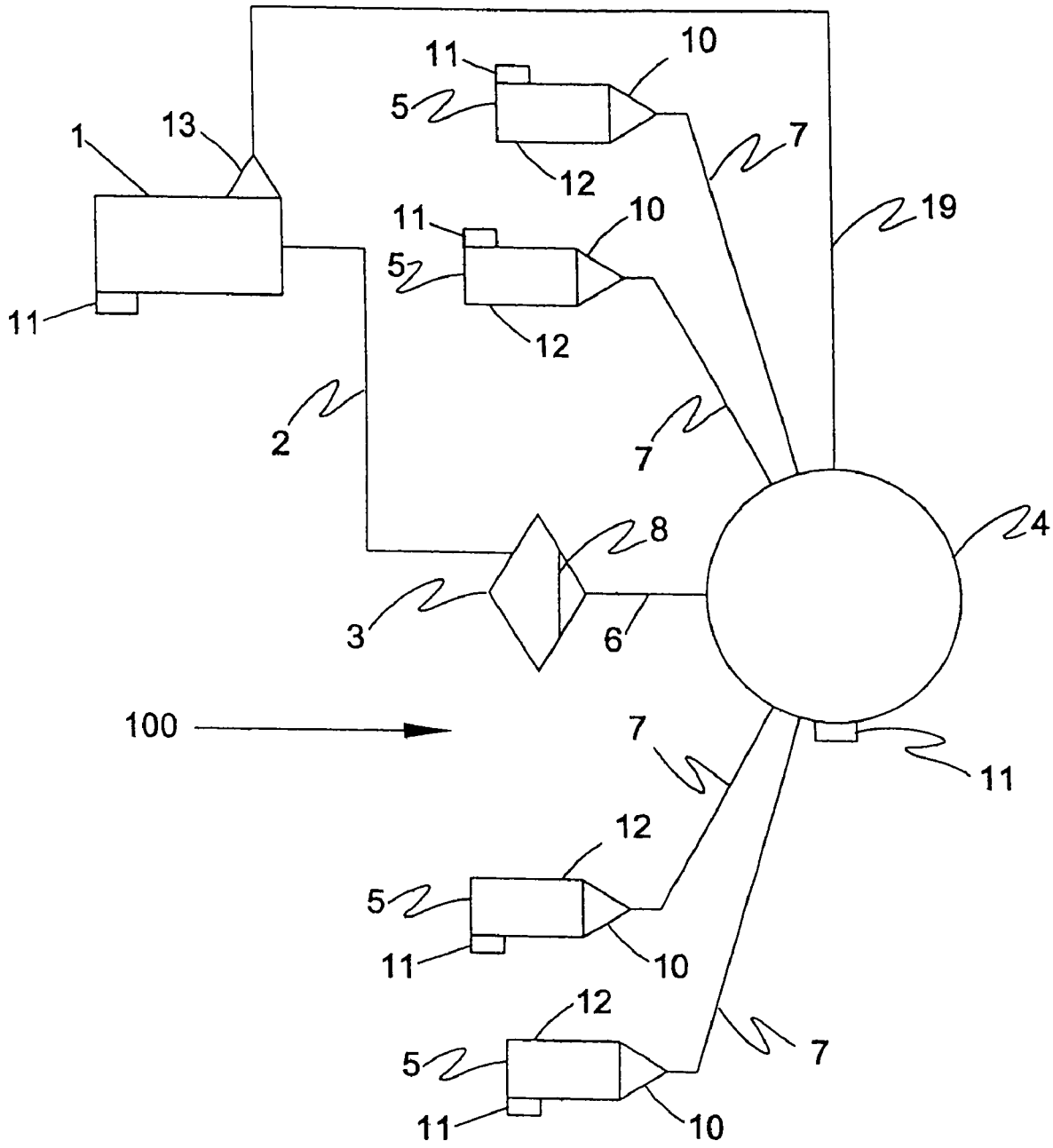
FIG. 1 is a schematic diagram of a communication system to monitor ingress and egress to and from a facility in which ingress and egress data from a first card reader are communicated to a base computer which communicates with a portable computer, and the portable communicates with at least one second card reader means.

Consider as a first example illustrated by FIG. 1, the emergency ingress/egress monitoring system 100 adapted to a large building with a large number of individuals, most of whom have a well defined work site. The minimum personal data for each employee is encoded in a magnetic strip on the employees identification card. All employees enter their personal data by passing their identification card through one of a plurality of first card reader means 1. The data are communicated to a base computer 3 that is in operational communication 2 with the first card reader means 1. Under normal conditions, the base computer 3 maintains a running census of individuals that enter the facility and removes the individual from the census when the individual exits the facility. The departure of an individual is monitored in a manner comparable to the entry monitoring with the use of the identification card removing the individual from the census of current occupants of the facility. Operational communication 2 between the first card reader means 1 and base computer 3 in the facility is most commonly and preferably by hard wire linkage. The invention anticipates wireless means as an acceptable alternative. In an expanded version of the system, the operational communication 2 between the first card reader means 1 and base computer 3 includes both the preferred hard wire and wireless means.

In the event of an emergency evacuation of the building, power the base computer 3 by wireless transmitter means 8 transmits 6 the current facility census occupancy data to a portable computer 4 located at a secure, remote site. The portable computer 4 communicates, preferably by wireless 7 means with a plurality of second card reader means 5 located at designated emergency assembly areas. Communication between the portable computer 4 and second card reader means 5 at permanently established emergency assembly areas may be by wired means. Maximum flexibility is maintained when the communication between the portable computer 4 and second card reader means reader is by wireless means. Each second card reader means 5 comprises a card reader element 12, an independent power supply element 11, and a wireless or hard wired communication element 10 capable of transmitting egress data entered into the reader element 12 to the portable computer 4.

The portable computer 4 has the capability to display and to produce (print) hard copies of both census data and graphic diagrams or plans of the facilities and similar materials. This information may be vital in rescue operations and in determining when rescue resources may be diverted from life saving/rescue activities to protecting property. The data, among other information, may provide critical information as to fully evacuated areas, areas with extreme hazards, and to locations of individuals that might require special assistance to evacuate the facility.

Employees evacuating the facility are directed to any of the emergency assembly areas at which employees indicate safe egress from the facility by passing their identification card through a second card reader means 5. The census data maintained by the portable computer 4 are adjusted such that at any time a list of those individuals that have not been safely evacuated from the facility can be produced for emergency workers. When the system is activated by a power outage or physical activation calling for emergency, independent power supply elements 11 on the base computer, portable computer 4, first card reader means 1 and second card reader means 5 are activated. In addition, a wireless transmitter device 13 establishes a communication link 19 between the portable computer 4 and the first card reader means 1 so that egress data entered at the first card reader 1 are included in the census data of the portable computer 4, thereby ensuring that all individuals safely evacuated from the facility including those that may egress by a normal entry and record their exit in the normal manner are deleted from the facility census for rescue purposes.

In one configuration of this example, the portable computer is adapted to receive egress data input by telephone such that an individual who had safely evacuated the facility but had not otherwise recorded his exit can do so by using any telephone instrument with digital capabilities and contacting a preestablished emergency number that accesses the portable computer. The portable computer is programmed to receive such telephone delivery of egress data and adjust the building census accordingly. The egress record of the individual may even include a notation that the individual reported from a remote site, not from a designated evacuation area.

The census data retained by the portable computer 4 include the location at which individuals not indicated as having been safely evacuated are most likely to be found. In addition, depending solely on the extent of the data entered initially, the census data may also provide information regarding special assistance an individual may require in evacuating the facility.

In an expanded model of the system, a schematic representation of the floor plan of the facility, for each floor or level is included as basic data in the base computer or programmed into the portable computer. When data indicate an individual has not exited the facility in an emergency, in addition to identifying the individual and the most probable location of the individual in the facility, a computer printout includes the appropriate schematic of the facility showing emergency workers the most probable or anticipated location of the individual, routes to that location, and related emergency information.

To ensure that the independent power supplies to the second computer and to the second card reader means units are maintained, each unit may be linked to an independent power supply element that may be solar driven or a battery based solar based power supply/charging unit (not illustrated). The independent power supply element 11 serving the base computer 1 and first card reader means are charged preferably by individual drip charger units.

In view of the heightened sense of security in many public facilities or facilities accessible to the public, the system of FIG. 1 is acceptably practical for monitoring visitors and guests to many facilities. In any situation in which the basic elements of FIG. 1 are applied to regular occupants of a facility, steps to monitor guests and visitors employing the same system are relatively simple to implement. A simple application is to provide each visitor with an identification card that merely indicates the presence of an individual in the facility. Name tags would continue to provide on site identification. Simple devices are available to generate temporary identification cards that would require the visitor to provide the same census information provided by employees, including destination within the facility. Such information enhances facility security and helps ensure the visitor maximum assistance in the event of an emergency during the visit.

The system anticipates, but does not require the use of an additional, simple head count means to monitor the gross number of individuals entering and/or leaving a facility through any monitored location. Individuals, either before activating the entry way reader or on entering a specific area of the facility, or both, activate a traffic count device such as a counter associated with an entry turn style or by breaking a light beam. Such devices are passive with respect to required actions by the individual, but add a significant, simple element of security by maintaining a continuous record of the number of individuals entering or remaining in a designated area, from an individual room to an entire facility. Data from such devices are transmitted and processed following the same manner as the previously described methods for card reader devices.

Example 2

Figure 2:
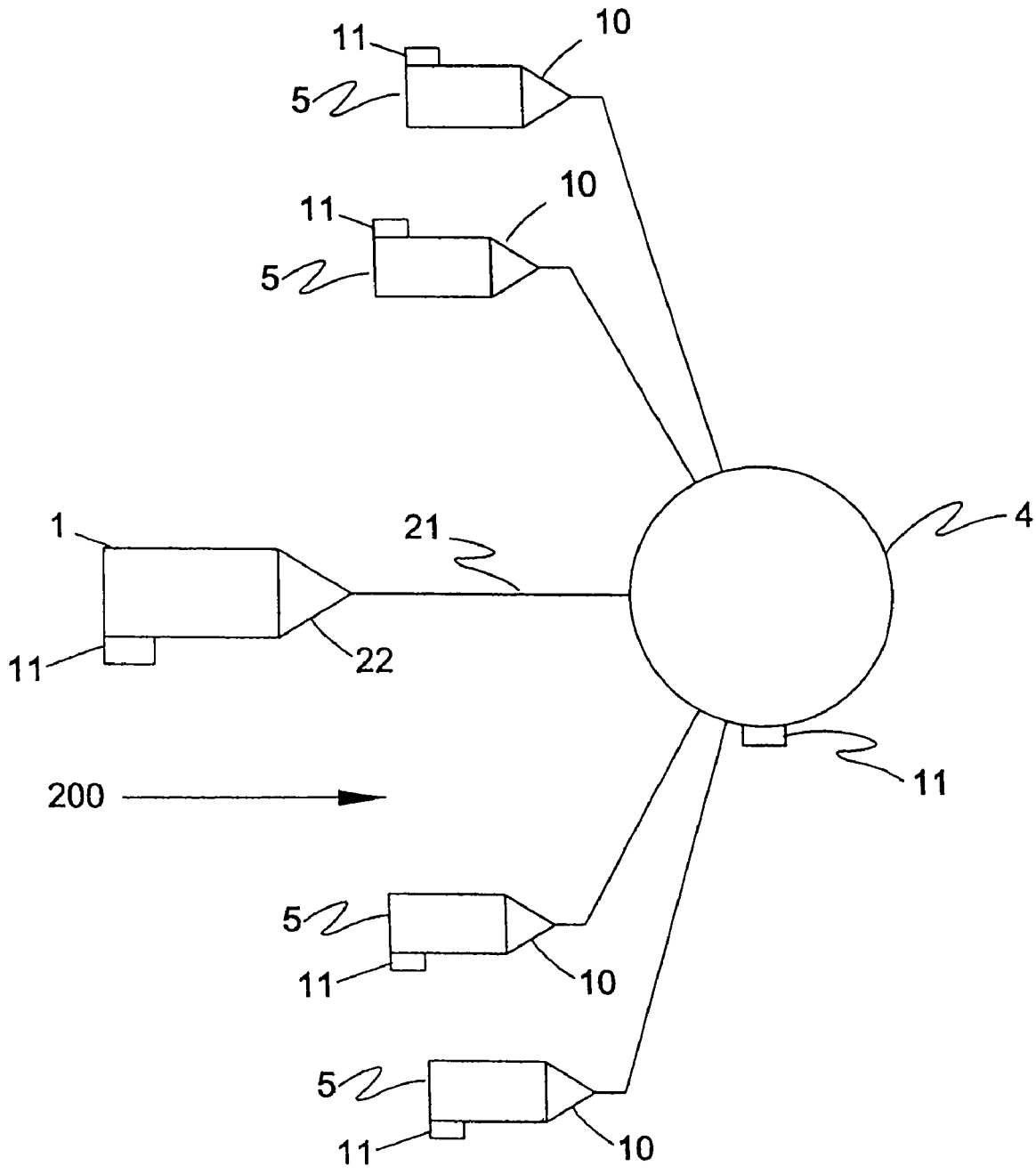
FIG. 2 is a schematic diagram of a communication system to monitor ingress and egress to and from a facility in which ingress data are communicated directly from a first card reader to a portable computer, and the portable computer communicates with at least one second card reader.

FIG. 2 illustrates a system 200 that tracks and locates employees and visitors in a facility in a manner similar to the system described in Example 1 and illustrated by FIG. 1. The system 200 of FIG. 2 comprises a basic first card reader means 1. The first card reader transmits personal identification (census) data such as employee name and work location as in Example 1. The first card reader means 1 includes, in addition to its independent power source 11, a wireless transmitter 22 that transmits by wireless means 21 the individual ingress data directly to the portable computer 4. The communication between the portable computer 4 and second card reader means is as described in Example 1. Because the portable computer 4 and first card reader means are active for collection of ingress and egress data, the power source is changed for emergency operations. The second card reader means 5 located at assembly points are activated by actual use of an individual passing an identification card through or against the reader element.

Example 3

Figure 3:
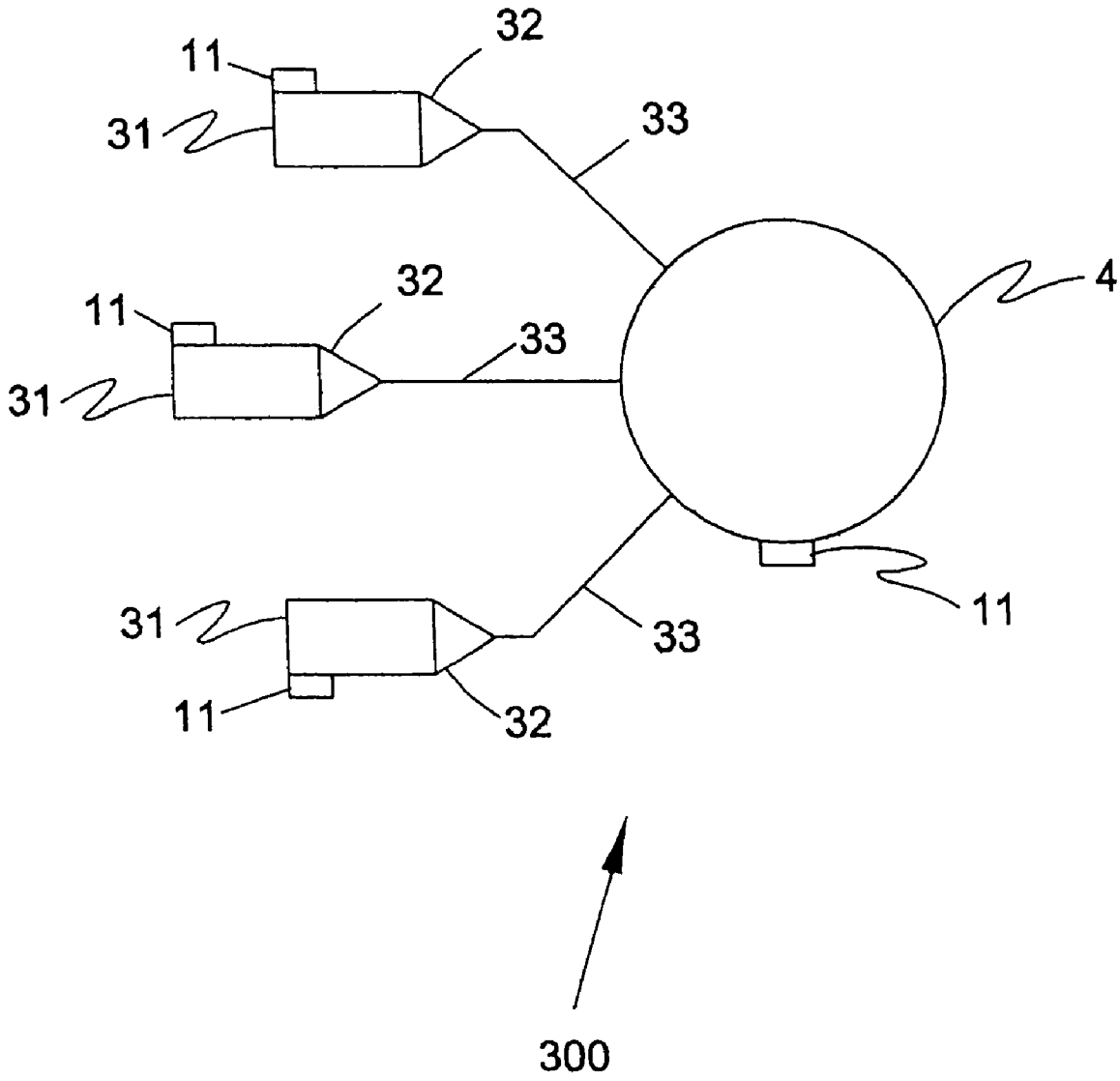
FIG. 3 is a schematic diagram of a communication system to monitor and transmit by wireless means ingress and egress data directly from portable card reader means a portable computer.

FIG. 3 illustrates an alternative system 300 to both Examples 1 and 2 as illustrated respectively by FIG. 1 and FIG. 2. Each card reader unit 31 functions as both an first card reader means and as a second card reader means. A transmitter/receiver unit 32 capable of wireless communication 33 with the portable computer 4 is integrated into the card reader means 31. Each card reader means 31 is supplied with an independent power source 11, and these independent power sources are adapted to being connected to a standard battery charger device (not shown). Both the portable computer 4 and card reader means are portable.

This system finds its most obvious applications in non-emergency situations such as monitoring individuals entering an area, leaving the area, and then re-entering the area wherein it is important to ensure that all individuals that leave the area return. By way of example, but not limitation, the system is applied to monitoring a group of students being transported by more than one vehicle to a location at which they will exit the vehicles for an activity (field trip) and then return to a vehicle.

A card reader unit 31 is provided for each vehicle, and individuals boarding the vehicle are recorded using common card reader technology as previously described. The vehicle census is transmitted to the portable computer 4 by wireless means. The exit of each passenger is recorded by passing the identification card through the reader, as with other systems. When the passengers return, re-boarding is similarly monitored by card reader. In every instance, the census data are transmitted to the portable computer 4. Prior to departing from the area, a final census is generated by the portable computer indicating whether all individuals that originally boarded any vehicle have re-boarded some vehicle. The computer is adapted to sound an audible warning if the egress data and subsequent ingress data do not agree, thereby indicating that at least one individual that exited a vehicle has not boarded any vehicle. If any individual is missing, a physical head count is conducted before a search is initiated. The initial ingress data may include names of passengers so that the warning will include the name of the apparently missing individual. Note as illustrated, the portable computer 4 serves the function of both the base computer and portable computer of previous examples. The system anticipates that a separate base computer can be used and that in this configuration all communications among computers and card readers will be by wireless means.

In many instances, for small children, supervisors will distribute identification cards for specific events and collect them following the event or activity for future use or recycling. Reasonable means are available to produce identification cards for individuals for specific activities.

Example 4

The system of example 4 can be expanded for varied situations, including monitoring individuals reporting to emergency sites, such as life boat stations of cruise ships. Magnetic room keys provide the necessary identification of the individual's presence at a site.

The preceding examples all call for and assume that census data will be entered by card reader means. These include both magnetic "swipe" cards and optical scan cards. Although such means are convenient and devices readily available, the invention anticipates data entry by other means, including key pad entry by individuals. Such key pad entry includes entry by telephonic means. The invention also anticipates the use of thumb print recognition technology as a means of providing ingress and egress data. In addition, with respect to the portable computer, the invention anticipates display of census data and list by visual display means and by means of lists printed by a printer device associated with the computer.

Example 5

Figure 4:
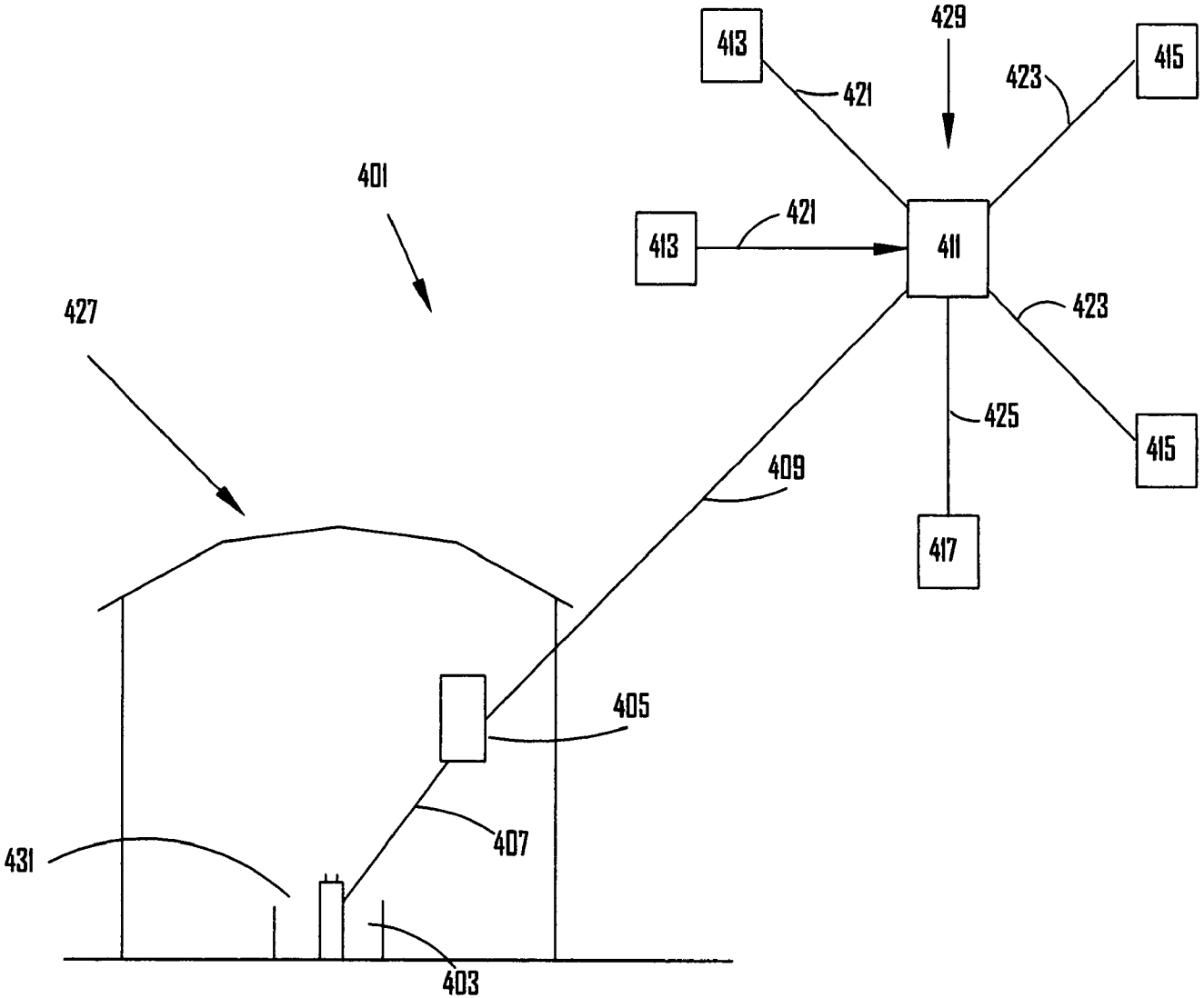
FIG. 4 is a simplified schematic diagram of the functions of an emergency ingress/egress monitoring system.
Figure 5:
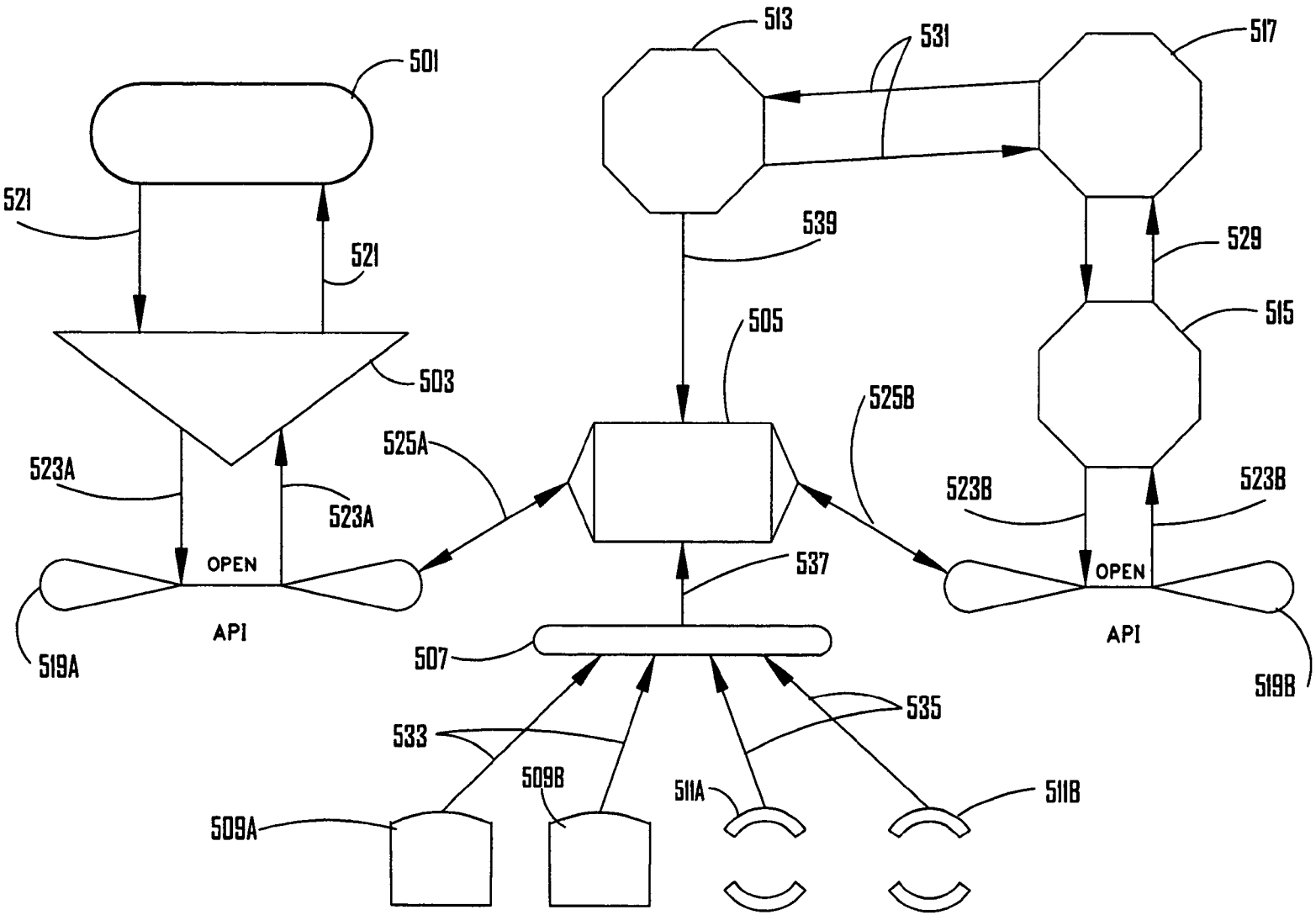
FIG. 5 is a detailed schematic diagram of the functions of an emergency ingress/egress monitoring system.

FIG. 4 provides the basis for a simplified functional overview and summary of the ingress/emergency egress monitoring system 401. Elements of the system are located in two separate sites, the facility to be monitored 427 and at a safe distance/location from the facility, at least one emergency assembly area 429.

Under normal conditions entry of individuals is recognized and recorded by an identification readers 403 located at normal ingress points 431. Ingress data are transmitted 407 to a first computer 405 in which a current facility occupancy census file is generated and maintained. This file is also transmitted 409 to a second computer 411 located at the emergency assembly area 429. One of average skill in the art understands that under normal operating conditions, egress of an individual is monitored just as ingress, and the occupancy census appropriately, continuously adjusted.

Under emergency evacuation conditions, personal egress identification data are collected by egress static readers 413 located at the emergency assembly area 429, and these emergency egress identification data are transmitted 421 to a second computer 411 located at the emergency assembly area 429. In addition, emergency egress identification of individuals not reporting to the emergency assembly area 429 is collected by mobile identification readers 415. These data are also transmitted 423 to the second computer 411.

The second computer generates adjusted facility occupancy census files and egress reports 417 using the initial building census file immediately prior to the onset of the emergency conditions as transmitted by the first computer 403 and adjusted by safe egress identification as reported to the second computer 411 by the static readers 413 and mobile readers 415 and transmits 425 such reports 417 for display by means to emergency workers.

The functions are summarized as generating a continuous facility census, recognizing emergency conditions, generating a continuous egress census, and then generating a facility census reflecting failure of individuals to evacuate the facility.

The functions are summarized as generating a continuous facility census, generating a continuous egress census, and then generating a facility census reflecting failures to report safe evacuation from the facility.

The emergency mass ingress/egress monitoring system (EIES) is most appropriate for buildings or facilities with a stable, identified population of occupants who ingress and egress at designated, controlled points and controlled visitor access. Regular in conjunction with appropriate hardware/devices, occupants use any of a variety of identification means, including, but not limited to swipe cards, other magnetic cards, generally personal identification systems recognized as radio frequency identification or proximity reader (RFID), and may include emerging identification such as, but not limited to hand print or eye pupil recognition programs with individual identification data loaded into a basic file and scanned for ingress/egress identification. An identification reader appropriate for the means of identification is located at each entry point. Such readers are known to those skilled in the art an and readily available through numerous commercial outlets.

In one best mode, the EIES is characterized and understood by function and functionality of specific elements. Function is generally defined or described as the action of the unit, and functionality as the result or product of action. Units may have more than one function and more than one functionality.

In one example, the EIES is characterized by four major functions with linking communication interfaces and open programming capabilities to accommodate fine adjustments for specific installations. The EIES is best understood by following functions and related functionalities from collecting initial ingress data to create an initial facility and specific area census to generating pairs of specific reports showing current safe individual egress and individuals not apparently safely evacuated from a facility under emergency conditions.

The four major units comprise (1) an input system comprising identification reader devices to read/recognize personal, individual identification data, a communication link that functionally connects the individual reader(s) such that the data can be communicated from the devices to the base computer to generate the initial facility census file; one of average skill in the art recognizes that under normal operating conditions, egress of an individual is also recognized and the occupancy census appropriately adjusted, and further that identification reader devices positioned at normal points of entry to monitor ingress under emergency conditions monitor egress at the same location; (2) a second, portable computer in wireless communication with the base computer and capable of recognizing and responding to the failure of the base computer to transmit a periodic, regular "normal" (non-emergency) condition or to otherwise respond to a message of emergency conditions such that a variety of emergency actions are initiated by the second computer, and the second computer is also capable of receiving and maintaining the initial census file from the base computer as it is periodically transmitted; (3) a plurality of static personal identification reader devices positioned at emergency evacuation assembly sites located safely away from the facility and to which facility occupants report to register safe egress from the facility said devices being adapted to read/recognize personal identification data and to transmit such data to the second computer; and (4) a plurality of mobile (hand held) devices in wireless communication with the second computer and capable of reading/recognizing personal identification data and transmitting that data to the second computer. The egress (emergency evacuation) data and are processed by the second computer to adjust the initial census file transmitted by the base computer to account for individuals known to have exited the facility (safe egress reported to a static or mobile device) and those apparently remaining in the facility. The function of the second computer is ultimately to generate to facility census documents: safe egress census individuals and individuals that have not reported to a safe area.

The system includes manual override capabilities and recognition of emergency conditions, including the capacity to initiate drills and activate only sections of the system for drills, testing and maintenance.

The first function is the initial access control file 501. This function comprises two major functionalities. The first functionality (not illustrated in detail) is the product of the routine, straight forward transfer of ingress information from personal information readers to the base computer and the base computer generation of an initial census file.

In addition to the personal information readers' functionalities of collecting data and communication to a base computer that generates and maintains the current, rolling census, the second functionality is communication with the safety core 505. This communication involves three functions associated with a computer element of the safety core 505. First, the computer element of the initial access control file function 501 at from 15 second to two minute or longer intervals communicates to the safety core 505 a message (signal) that the entire EIES is operating under "normal" conditions. So long as the message is received, the safety core 505 function is relatively passive. Periodically (every 2 to 10 minutes or longer as may be specified for a particular application, the access control file function 501 transmits the current facility census to the safety core 505 the result of functionality is that duplicate census files are maintained and potentially available for different, emergency purposes.

The safety core 505 and the initial access control file 501 both communicate (521, 523A, and 525A) with the access control interface 503 through the first open API 519A. If the safety core 505 does not receive the "normal operation conditions" message through the access control interface 503, the safety core 505 function recognizes an emergency condition has occurred and initiates a plurality of steps directed to addressing the emergency conditions. The functionalities including directing all elements of the EIES to initiate independent, self-contained power sources on each static station during a daily test or drill, or in response to an actual emergency evacuation. A second functionality is all emergency static egress readers 509A and 509B at designated, remote assembly sites are activated to record egress of facility evacuees entering the site and transmit the data to the safety access core so that the occupancy censuses can be corrected to reflect evacuees and those not reported to be safely evacuated from the facility. The readers at the evacuation sites are static egress readers and read identification data in the same form and format as the facility ingress/egress readers. The location of the evacuation site(s) and number as well as the number of static egress readers is installation specific; for reliability, generally at least two emergency static egress readers 509A,B will be located at each site, and the evacuation site location will be determined by local conditions.

In addition to the static readers, this functionality includes activation by remote message of mobile (highly portable) readers 511A and 511B. Because the access control file ultimately stores census data as a recognized name associated with other information, the mobile readers need only have the capability to record/transmit alphanumeric data (names social security number, and so forth) even if the initial ingress was recorded as a hand print or other characteristic. The mobile reader 511A,B allows reporting egress of individuals located at places other than the designated assembly areas, such as medical aid stations or other facilities.

The ingress/egress readers associated with the initial access control file function 501 may remain functional and if so are independently powered at the onset of an emergency and transferred to direct communication with the safety core 505. General practice requires that if all individual reporting to an assembly site report egress through the static reader elements 509A and 509B. The safety core 505 is protected from failure due to duplicate reports of safe egress such that under emergency conditions, when the system recognizes egress of a specific individual, the computer ignores any subsequent egress report of that individual.

The cumulative functionality of emergency egress monitoring is the establishment of two files: safe evacuees as egress has been reported and apparent failure to evacuate as a result of no report of safe egress. In the latter case, individuals are further identified as to at least a work station site in the facility at which the are most likely to be located and individuals that might require special assistance are identified. The files become useful information as a product of the fourth function.

The fourth function is generation of the end user product 513. This product based on specific site requirements reports in readable for the information in the two files generated as a product of the safety net core 505 function. The files can be made available rapidly in hard copy and or display on any approved computer facility for use by rescue personnel. The second open API link 519B, comparable to the first link 519A really represents a function or result prior to an emergency not to the specific emergency, in that it indicates flexibility to generate the final, end user product 513 in a case specific form or format and to manage distribution and directions to rescue personal and other emergency workers, API 519A means to adjust to location/facility specific needs or conditions; this function can be incorporated into interface 503.

Given the preceding discussion of function and functionality, actions and results, lines of communication and necessary computers/unit interfaces become logical appendages to the functions. The function of the initial access control file 501 to provide its functionalities is in two way communication with 521 with the access control interface 503. Similarly, the user specific design 515 is in two way communication with the open API 519B, and the open API is in two-way communication 525B with the safety core 505. The access control interface 503 provides computer linkages to transmit interpret the normal operations message and signal if that message is not transmitted. The access control interface 503 as illustrated is in two-way communication 523A with an open programming interface 519A that is not an active element in any function/functionality, but is included to allow for specific system modification between the independent computer element of the initial access control file 501 and the corresponding, independent computer element of the safety core 505. The two-way communication between the initial access control function and safety core 505 function is indicated by communications lines 521 connecting the initial access control file and the access control interface 503, lines 523 connecting the access control interface 503 and open API 519A and line 525 connecting the first open API 519A and the safety core 505 function. The connection between the initial access control file to the safety net core file could be directly through the access control interface, without eliminating the necessary flexibility or altering the scope purpose, or intent of the invention.

The static safety readers 509A,B and mobile safety readers 511 are linked by one-way, communication 533 and 535, respectively to the reader interface 507, and the reader interface 507 linked by one-way, wireless means 537 to the safety core 505. The end user product 513 is linked by wireless means 539 to the safety core 505. The static safety net station communication link 533 to the safety core may be wired or wireless; the corresponding mobile link 535 is wireless.

In a similar manner, the safety net core 505 is linked in two-way communication with a second open API 519B that communicates with a user specific design element 515 to a graphic user interface 517 and ultimately to the function of the end user product 513. Communication lines are two-way, starting from the safety net core 505 to the end user product 513 respectively in sequence as follows 525 527, 529, to 531. The open API 519B and user specific design 515 represent undefined specific system unique for any given installation and that do not affect directly the described essential functions and functionalities. The two way communication 529 between the user specific design 515 and the graphic interface 517 and communication 531 between the graphic user interface 517 and end user product provide the capability for flexibility in presentation of the final function of the EIES, the census reports generated continuously in response to egress from the facility under emergency conditions.

The static egress readers 509A,B and mobile readers 511A,B communicate are in unidirectional communication 533 with the safety net core through reader interface 507.

As one skilled in the art recognizes, although only two static stations and two mobile units are shown, the figures are for illustrative purposes only and not as limitations. The only limit suggested is adequacy for the circumstances of a particular application, and this clearly is a function of the size of the facility and specific area, the number of individuals potentially involved in an emergency evacuation, and the proximity of suitable assembly sites.

Example 6

For large facilities or areas, such as, but not limited to arenas, stadiums, and theaters, monitoring ingress/egress on an identified, individual basis has significant technological challenges. None-the-less, accurate ingress census (head) count has great potential in monitoring emergency evacuation and increased value when census count data is associated with occupancy of specific seating locations and when evacuation from such locations follows a specific route or leads to a single assembly area. The value of census count data may increases when it is associated uniquely with an individual, even when the individual has no personal identification means.

For all anticipated systems, it is assumed that ingress data are communicated from a census count device to a base, remote server or computer removed from the site of the emergency conditions. Head-counters of various types are well known to those skilled in the art, for example, but not limited to turn style, electric eye beams, ticket stub scanner/counters, RDIF and the like. Counter capacity is an important consideration to minimize crowding/delays and related problems during normal ingress.

Traditional rotating turn styles are relatively slow and not appropriate for certain types of facilities and specified areas. Electric eye counters are more rapid and generally less intrusive, but may be subject to missed counts under fast moving, crowded condition, but improved technology has minimized missed counts resulting from crowded conditions.

Count data from each, individually identified count device are communicated directly to a base server wherein the initial ingress census is generated from the sum of ingress counts and associated with the specific location of each counted.

Ideally, each "count" is associated with a specific, assigned seat destination/location. This is readily accomplished when the ticket stub is the basis for the count, and seat location and area are coded on the ticket stub and on the ticket retained by the occupant. The count and location are transmitted as a unit.

A practical alternative is counting individuals when they reach a designated point of entry for a specific area in the facility. Each count device includes the same location identifier for all ingress counts made.

Under non-emergency conditions, egress data are not scored, and the ingress data are either stored (archived) for record keeping purposes or the system is purged to ensure a "clean start" the next monitored activity or event at the facility or area.

Under emergency conditions the emergency egress countering function of the monitoring system is activated either electronically or by manual over-ride. Egress counting devices are activated at four types of exit sites. Counters that routinely count/report ingress entry points automatically convert to score and report egress from the same point; counters at designated "exit only" points are activated; counters at emergency exits are activated, as are egress counters at potential, non-public (employee only) ingress/egress points.

In one configuration, additional counting devices may be spaced a designated distance apart in egress halls, tunnels, and ramps. If the number of individuals passing a second counting point in a specified period of time is significantly less that the number passing a first point in the same hall, tunnel, ramp, the assumption is justified that the route is in some way blocked and special help may be required to assist those individuals using that route. In an emergency evacuation of a facility, egress data are continuously transmitted to the base computer and total egress as well as egress from each designated area in the facility are displayed on approved computers to identify areas in which egress is apparently slow as a result of damage to the facility, blocked routes, or related conditions, thereby providing rescue personnel with immediate, real time detailed evacuation status information to assist in planning rescue operations.

The goal is safe, rapid egress in a manner in which crowding is minimized so that reliable counts can be made. As one skilled in the art recognizes, ingress, and particularly egress routes will be highly unique to a facility. As one skilled in the art also recognizes, that there technological adaptions and creation of new technology that can provide identification and accountability with respect to the overall objectives with the ingress/egress solutions.

Figure 6A:
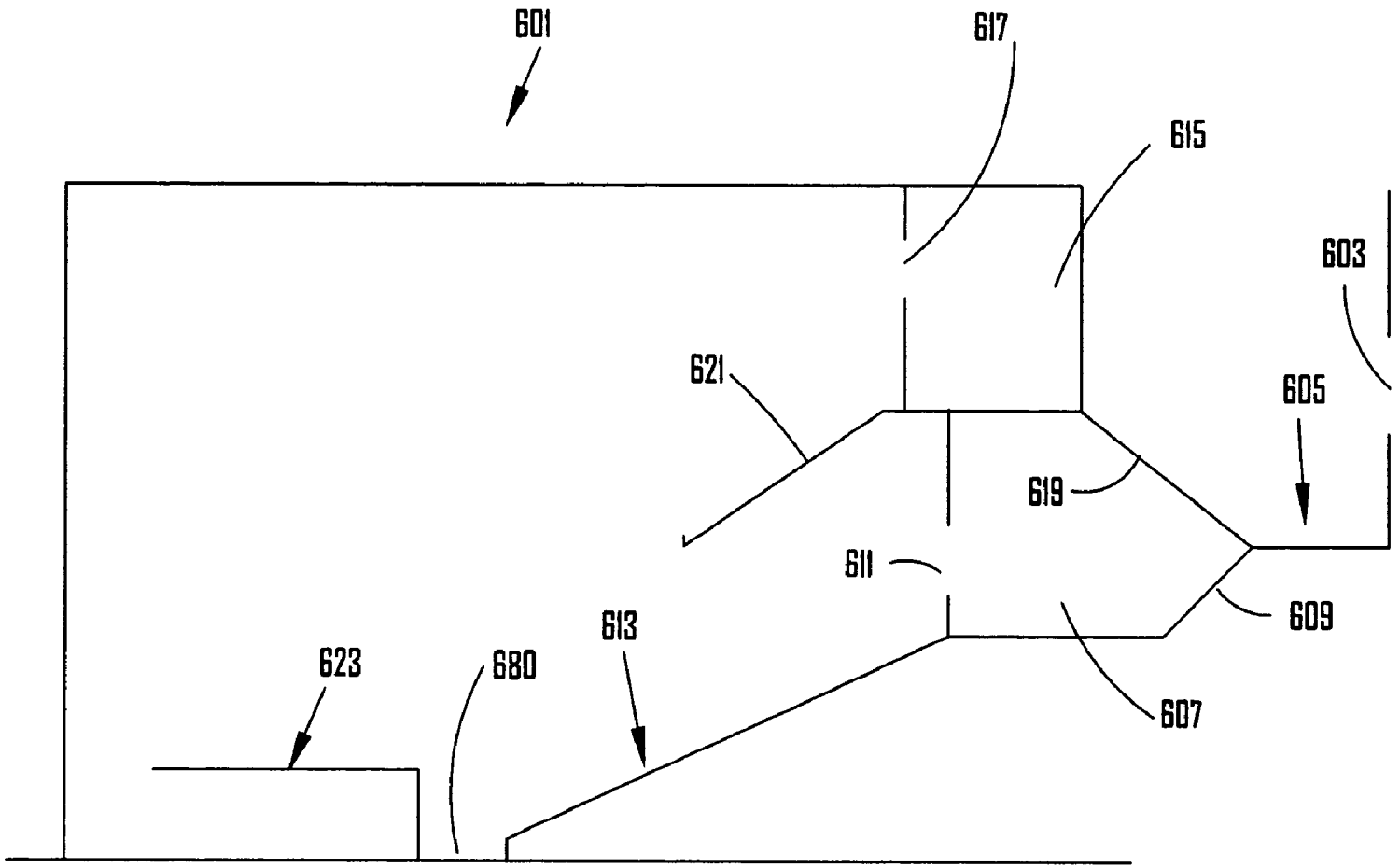
FIG. 6A is a cross section diagram of two-tier seating levels and access in an entertainment facility.
Figure 6B:
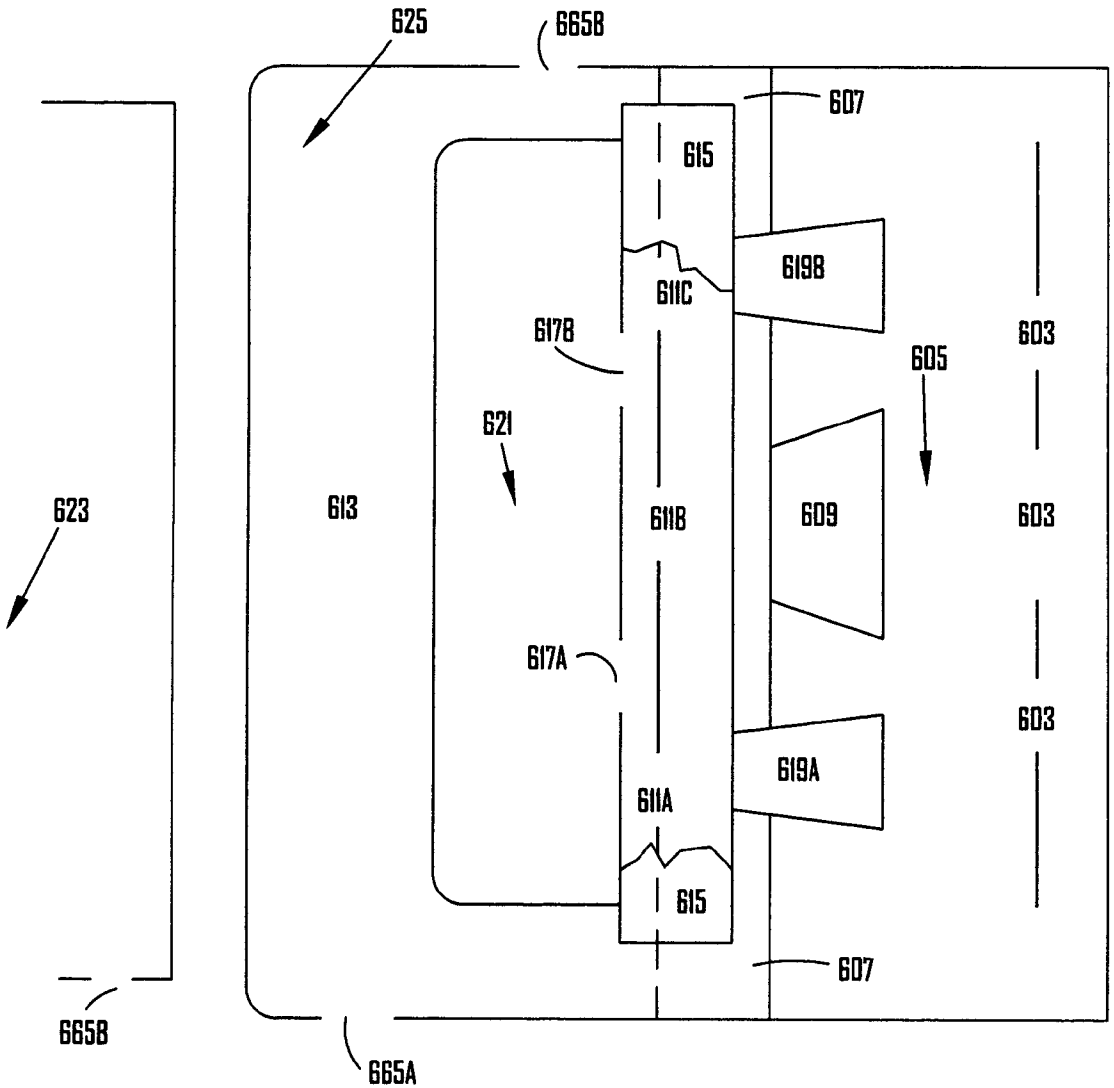
FIG. 6B is a top view diagram of two tier-seating levels and access in an entertainment facility.

FIG. 6A illustrates a facility cross section view 601 with seating on two levels, main floor level 613 and a balcony floor level 621. Entry is generally through a main entrance 603 at which tickets may be taken, into a general entry foyer 605. At this point crowding may limit accurate counting. Individuals are directed to one of the two seating levels, the main floor seating via main floor stairs 609 to main floor hall 607 or to balcony stairs 619 and balcony hall 615. Entry into main floor seating is via doors to main floor 611 and to balcony via balcony doors 617. Stage or performance floor 623 is separated from main floor by front aisle 680.

The facility from a top view 625 shows possible orientation of main floor steps 609 and balcony steps 619A (left) and 619B (right). The main entrance comprises several doors 603, and three doors to the main floor left 611A, center 611B, and right 611C provide access to main floor seating 613 from main floor hall 607.

Similarly, the doors to the balcony comprise two doors left 617A and right 617B from the balcony hall 615 to balcony seating 621.

Figure 6C:
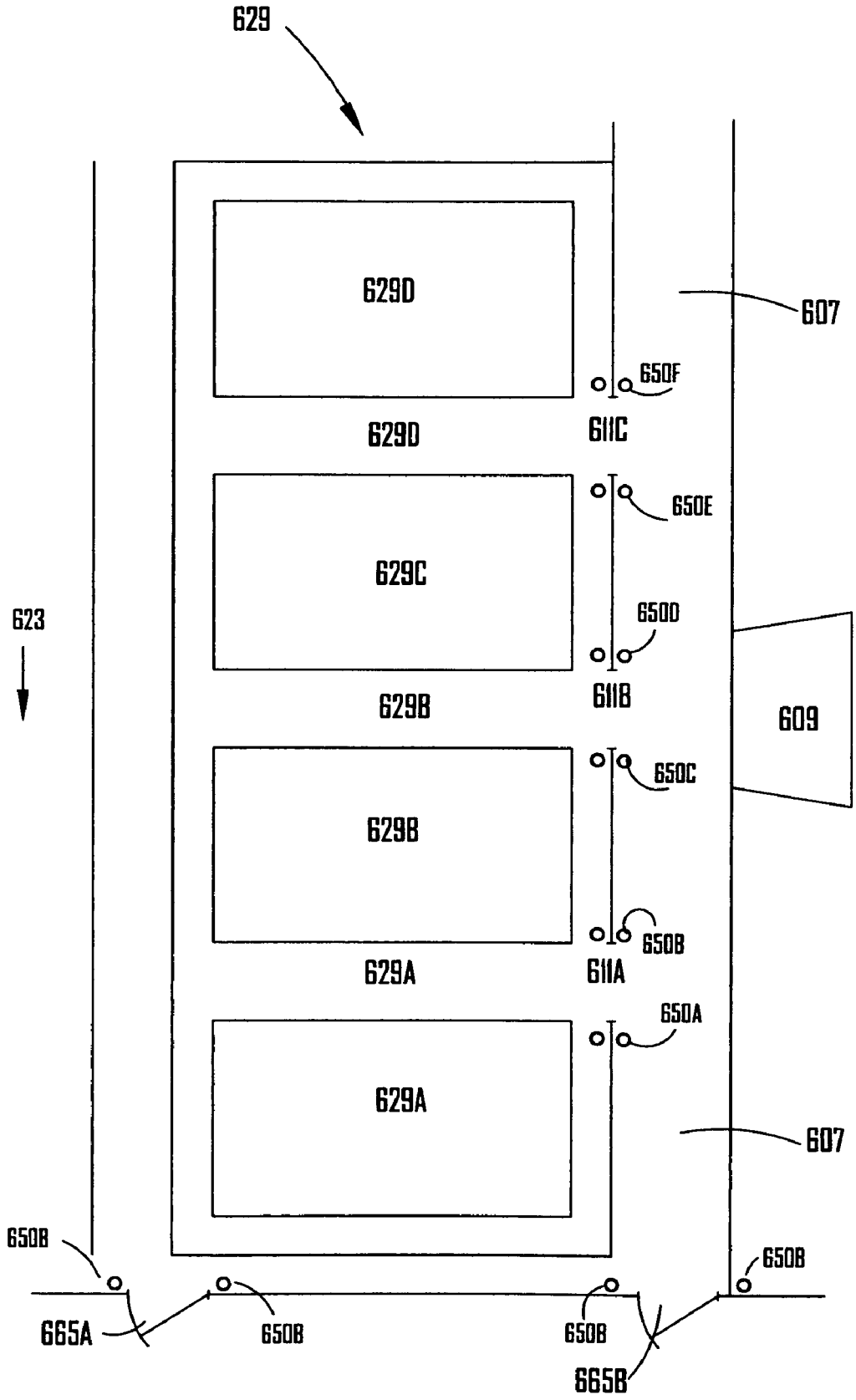
FIG. 6C is a top view diagram of main floor level seating and access with locations of ingress/egress monitoring devices.

Details of main floor seating and counting devices are shown in FIG. 6C. Individuals with seats on the main floor enter the main floor hall 607 by main floor stairs 609. The main floor seating 629 is divided into four sections left 629A, left center 629B, right center 629C, and right 629D. Access to these sections is by one of three main floor doors appropriate to the designated section left 611A, center 611B, or right 611C an appropriate aisle left section aisle 627A, left center and right center 611B, and right 611C.

Ingress counting is accomplished by electric eye or mechanical counters 650 or the like positioned at each of the three doors 611A, 611B, and 611C. Each counter 650A-F on the main floor identifies ingress by location, i.e. 650A,B ingress to left main floor seating.

Figure 6D:
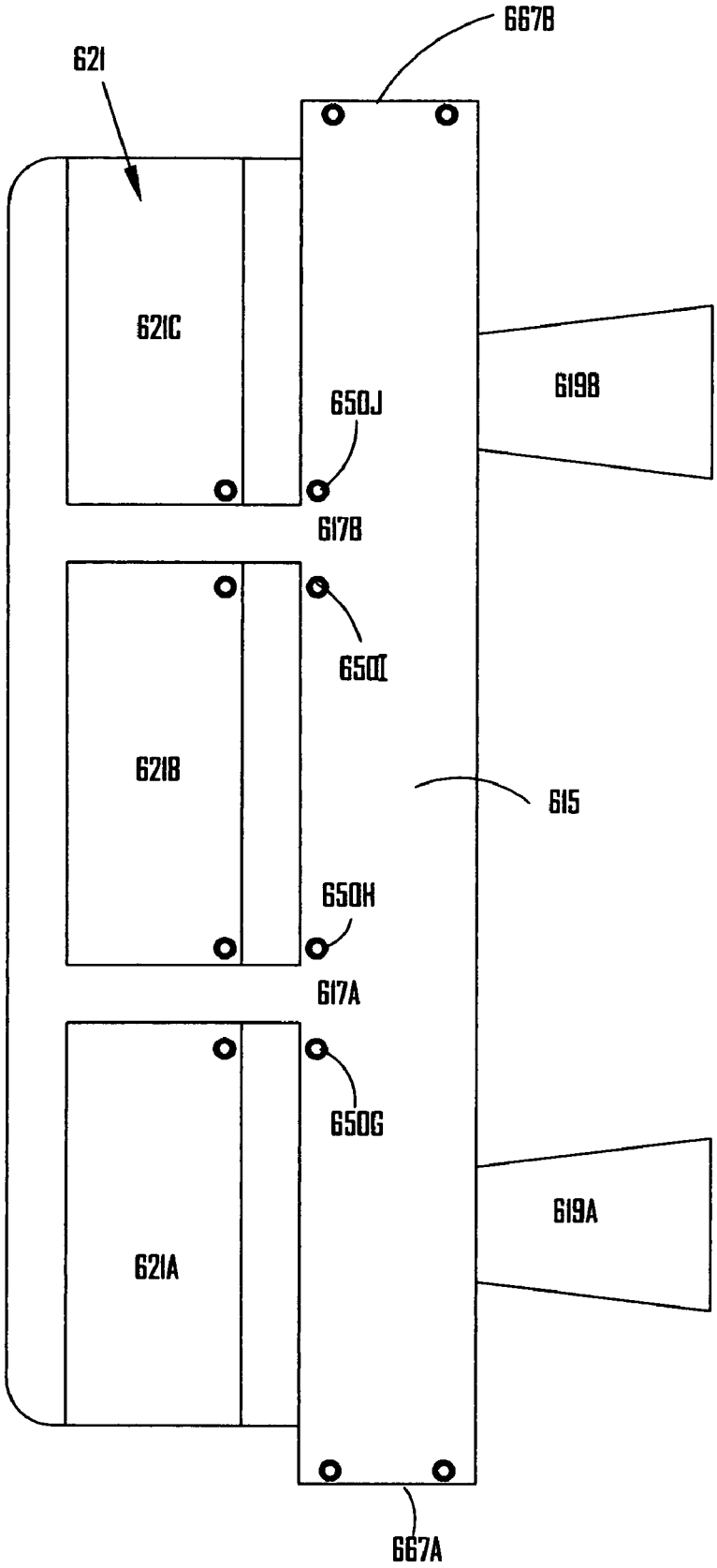
FIG. 6D is a top view diagram of balcony level seating and access and locations of ingress and egress monitoring devices.

Details of balcony seating are shown in FIG. 6D. Access to balcony hall 615 is by left 619A and right 619B balcony stairs. Entry to balcony seating 621 is from balcony hall 615 via two doors to balcony seating left 617A and right 617B. The balcony seating is divided into three sections left 621A, center 621B, and right 621C. Ingress counting is accomplished as for the main floor with counting devices 650G-J and counts reported for each location by entry door.

One skilled in the art recognizes that the configuration of the facility is for illustrative purposes only. More than two levels or floors may be included, and seats may be divided into more sections. Scoring or counting ingress at individual entry doors is favored for two reasons: counts are identified with a specific location in a facility which allows monitoring of emergency egress from the same locations and better allocation of emergency/rescue resources, and from a practical vantage, crowds are minimized as occupants disperse to individual doors reducing delays and congestion and making counting simpler and more accurate.

Although initial census may be collected at a main entry point, screening at entry doors to specific seating area doors is preferred for at least two reasons. Fewer individuals pass through any individual door; therefore the burden on any scanner and need for speed to avoid congestion and delayed seating are minimized and inaccuracies from skipped or multiple counts are minimized.

Under non-emergency conditions, occupants exit the facility generally through doors and halls through which they entered, or through designed exits only doors 665A and 665B for example on the main floor that are secured and not available for ingress for purposes of building security and ticket monitoring.

Under emergency exit/evacuation conditions, individuals may exit as they would under non-emergency conditions, including the exit only doors 665A and 665B, or they may exit by additional, emergency routes not normally opened for egress, such as fire escapes 667A,B serving the balcony seating. These may include, but are not limited to service access hallways and stairs, external escapes, performer/employee entrances 669, including through dressing rooms and the like, and even certain utility tunnels and maintenance routes and shafts associated with the stage area 623. Such additional routes are highly location specific and not shown by illustrations herein.

The score/count devices 650A-J at each designated egress "door," including normal entry doors are automatically activated to record (count) individuals exiting the area and transmit count data, identified by location of the count device, to the base computer. Similar egress count devices 650K-N and 650N-P for egress only doors 665A,B and fire escapes 667A, B, respectively are in directly in communication with base computer to transmit egress data for each location.

Physiognomic data are similarly collected and transmitted from all exits (including exit only and emergency exits as described above).

The base computer performs several tasks. First, by electronic signal generated by the base computer all secured exit only and emergency exits are opened (unlocked), all monitoring/recording devices are activated, audio and video devices located throughout the facility in established exit routes are activated, and the base computer continuously receives egress data. The current egress data are used to adjust the final ingress data for total egress and for egress from each specific seating area.

Relative egress from each area is continuously calculated as total area ingress minus reported egress from that area. Any area with reporting relatively slow or low relative egress is flagged in the continuous egress report and rescue personnel review and modify rescue activities as appropriate. Rate of initial egress from a designated section is estimated on final ingress census data and periodic egress census. A high initial census and low egress count suggests possible evacuation problems and the need for emergency personnel.

Similar steps are taken in reviewing the egress counts made from two or more points along an egress route to determine excessive crowding or damage that is adversely affecting egress along the particular evacuation route. The base computer also continuously generates a real-time census report for the entire facility and for each designated section. Reports are displayed and generated in hard copy as needed. Reports are also communicated directly from the base computer to authorized fixed and mobile servers.

Egress is counted as individuals exit a designated seating area by normal entry point, normal, but exit only exit point, or designated emergency exit point. Final egress from a facility after exiting a seating area may require passing through or along a designated "safe" evacuation hall, corridor, or similar passage way. Safe movement (generally recognized as rapid, uniform flow of traffic) along the route is monitored by pairs of counters at separate points along the route; high passage rate count at the proximal end of the route (end nearest seating area) and low passage rate count at a distal point suggests crowding or potential blockage of the passageway. The potential problem is highlighted in the continuous egress census reports, and one-way video and two-way voice communication links along the route are activated to allow real time viewing of conditions along the route and help identify problems. In addition the voice communications allows transmission of additional safety/evacuation instructions as well as condition reports from specific locations. The video/voice capabilities may be part of a facilities normal security network, or unique to the ingress/egress monitoring system, so long as they can be activated under emergency evacuation conditions.

Figure 7:
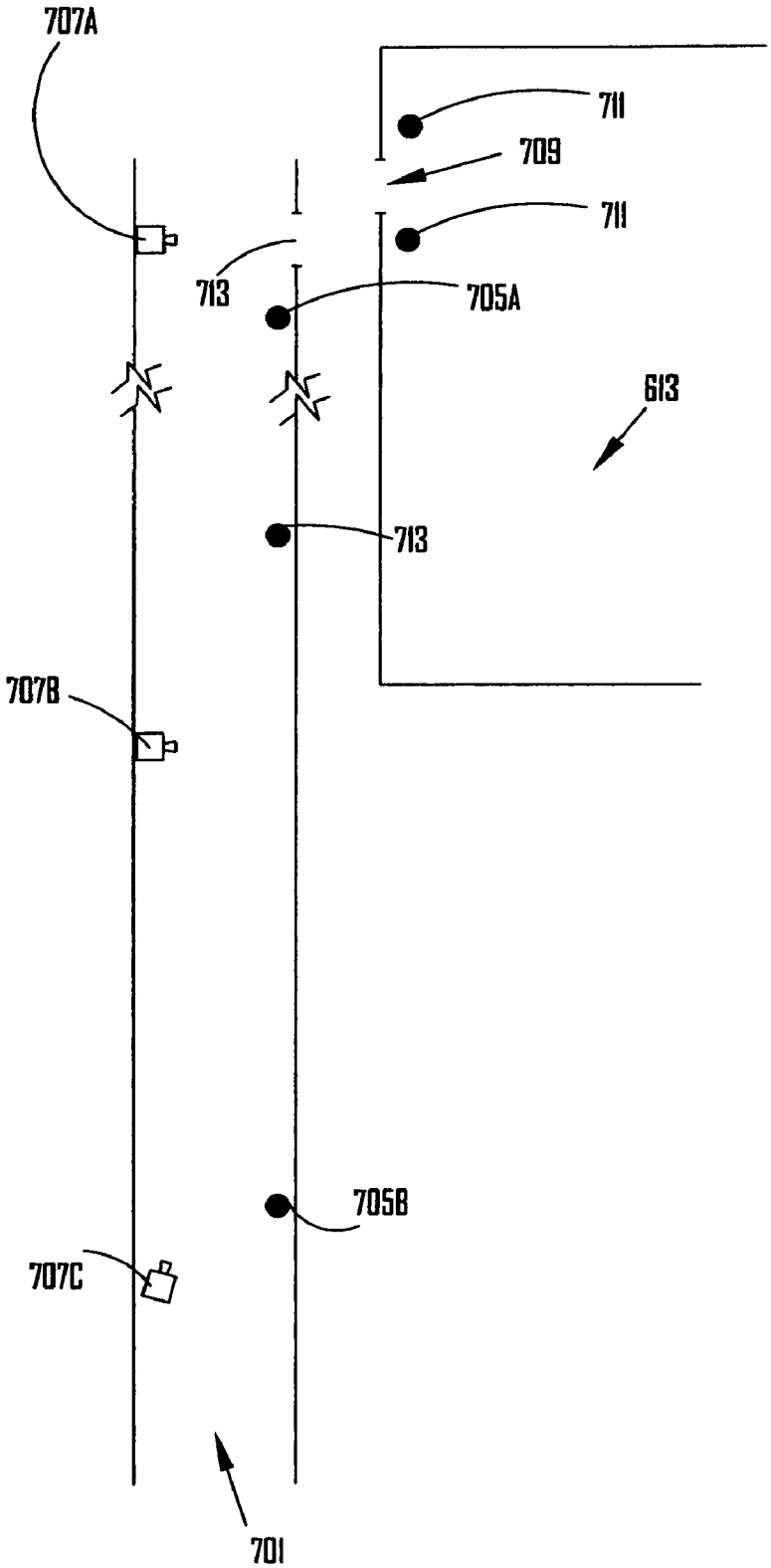
FIG. 7 is a top view diagram of emergency exits, passageway, and locations of egress monitoring devices and of video monitoring and voice communication devices.

The egress/evacuation rate monitoring is illustrated in FIG. 7. For example, individuals evacuating the main floor 613 enter emergency evacuation hall way 701 by various doors 709 at which egress is monitored 711, into hallway 701 by door 713. Rate of evacuee passage is estimated by the differences number of individuals counted by proximal counter 705A (proximal to main floor 613) in a specific, short period of time (generally one half minute to three minutes, but not limited to these time intervals) minus the number of individuals counted by a distal counter 705B counted over the same duration, but delayed to allow individuals to normally reach the distal counter 705B.

If the rate is slow (for example, but not as a limitation, the distal passage is more than 10 percent less than the proximal passage for corresponding time periods), a potential problem is indicated and video monitoring cameras 707A,B, and C are activated to afford real-time viewing of the route and identification of causes of slowed egress rate, and two-way voice communications 707 are opened to allow communication of instructions and reports of on-site conditions. It should be noted that video and voice monitoring capabilities may readily be extended to any seating area or location in the facility without the need to monitor evacuation rate.

The evacuation rate monitor aids in identifying evacuee traffic flow in and along established routes that are normally considered to be safe, regarding emergency conditions. Because all occupants do not necessarily pass along such routes (egress may be from a seating area relatively direct exit or through an area in which directional flow is not practically monitored, such as individuals exiting a seating area by an entry door and exiting the facility through the main entrance or from the seating area via doors opening to the exterior of the facility. The primary purpose of the rate monitor is to allow evaluation of egress involving a route in to the exterior of the facility in which crowding or an unexpected blockage could require special, emergency assistance.

The advent of rapid scanning technology to measure individuals quantitatively for a variety of traits with unique, individual values makes possible a more sophisticated mode of censusing both ingress and egress from a facility. The traits, broadly recognized and defined as physiognomic characteristics or traits include, but are not limited to specific head, face, neck and skull structure, eye (pupil) characteristics, a thermal profile, finger prints, and walking characteristics.

In addition to scanning/counting individuals even in crowded conditions, scanners to simultaneously score an individual for one or more physiognomic traits and associate these data with a counted individual (that is maintain individual identity of such physiognomic information) are available, and increasingly practically affordable. The traits scored are analogous to finger prints, everyone has them, but rarely if ever (with the exception of identical twins), do two individuals share the same specific prints. When more than one trait is considered, the probability of duplicate identifications is effectively zero. Even for a single trait, the probability suggests a very rare event, and such possible duplication has a negligible impact on creating a facility census to be use for determining ingress/egress status of a facility. Effectively, scanners provide a "count" of individuals passing by/through a check point'; physiognomic data provide a second scoring basis and may allow determinations that specific individual recorded as having entered a facility and specific area have exited, without the known identification of that individual.

Physiognomic information is scored for individuals on ingress and egress. The goal is to scan all individuals during ingress and emergency egress for the same physiognomic traits. This requires suitable scanners to be appropriately located and positioned in conjunction with each counting device, and, as with the counting device, physiognomic information must be identified with a specific seating location code for each individual recorded.

As one skilled in the art understands, physiognomic observations are generally scored and transmitted in a digital form and format; the digital data are translated by the base computed to provide user friendly score data results.

The physiognomic data as well as the head count data are communicated to the base computer and matching ingress/egress data pairs as determined by computer analysis indicate that a specific individual has exited the facility at the point at which the egress data are recorded.

Initially, the computer compares all ingress data. If duplicate information is identified, the data are coded to indicate the probability of more than one score for an individual (duplicate scanning). Similarly, all egress data is screened for duplicates.

Even with physiognomic data, personal identification is possible, individual physiognomic data can be independently entered and these data compared with collected ingress and egress data such that when matches are made, the safe assumption is made that the specified individual entered and exited the facility. Such use does not require additional elements of the invention, but it is not an anticipated common use for large facilities assumed herein.

In addition to census counts, simultaneously, physiognomic screening devices 650 are positioned to screen individuals passing through the door to seating areas. All data are maintained separately for each individual screened, and as for the census data, physiognomic data are coded to indicate/identify the specific location at which the individual entered the facility and presumable establish the seating area occupied.

Individuals entering main floor seating 29A,B,C, and D enter through doors 611A,B, or C. Physiognomic screening devices 660A-F screen for designated individuals for designated traits ant transmit data to the base computer in a manner comparable to transmission of the count data. Similarly, individuals entering balcony seating via doors 617A,B and screened by devices 650G-J.

All census count devices, physiognomic scanning instruments, and emergency voice and visual communications devices are powered by independent, individual power sources that are regularly recharged and tested. Although not part of the census count capabilities, the system includes two-way audio and one-way video capabilities with microphones and speakers and remotely operated camera positioned in individual sections and at strategic locations along evacuation routes. The available one-way video can be used to view at least segments of routes of concern to help determine if a serious situation is emerging in a given section or along a given evacuation route.

As one skilled in the art clearly recognizes, the organization and arrangement seating varies with each area or facility as does access to seating sections, location of aisle and access to each, and the location of emergency evacuation routes, halls, tunnels, and the like. Gathering both ingress and egress census data at the point closest to the designated section or similar defined number of seats is preferred to scoring at major entry points for at least two reasons: to minimize crowding and delays and annoyance to patrons and by less crowded conditions to better ensure minimizing skips or missing individuals or duplicate counting. Precise location and arrangement depends on the device employed. Simple, electric-eye census count devices are mounted in door moldings at about waist level, for example. Devices to score physiognomic traits must be positioned so as to scan the proper portion of the body of the individual; for head, face, and neck traits, including eye characteristics, ceiling or wall mounting to focus slightly downward is preferred. In some instances, for monitoring, individuals are directed to glance directly at a designated device.

It should be noted that gathering occupancy census data of any type as used in the emergency egress monitoring system does not violate rights to individual privacy because the data are utilized outside of the facility or area and because individuals are not identified.

Preferred embodiments of the invention have been described by specific terms and devices for illustrative purposes only and are words and terms are words of description, not of limitation. Changes and variations may be made by those of ordinary skill in the art without departing from the spirit or scope of the invention, which is set forth in the following claims. Aspects of the various embodiments may be interchanged in whole or in part.

I claim:

1. An ingress/emergency egress monitoring system comprising:

a first function carried out by a first functional unit, wherein said first functional unit produces two initial functionalities;

a second function, wherein said second function depends on at least one of said two initial functionalities, and wherein said second function generates at least one product functionality;

a third function wherein said third function comprises transferring the functionality of said third function from one or more fixed locations to said second function, and a fourth function, wherein said fourth function comprises transmitting the functionality of said fourth function from one or more mobile locations to said second function;

wherein said two initial functionalities comprise collecting ingress information and transmitting said ingress information to a base computer wherein said base computer generates a current occupancy census and wherein said base computer transmits said current occupancy census to a second computer, and wherein under normal, non-emergency conditions said base computer continuously transmits to said second computer a normal operations signal; when said second computer fails to receive said normal operations signal from said base computer, said second computer initiates emergency operation functions;

further, wherein under emergency operations functions, said third function transmits to said second function emergency egress information entered at said static readers located at one or more fixed locations wherein said second function generates and maintains a continuous emergency egress census of the facility; and wherein under emergency operation conditions, said fourth function transmits to said second function emergency egress information entered at readers at none or more mobile locations wherein said second function generates and maintains a continuous emergency egress census of said facility, and wherein said emergency egress census comprises said egress information entered at said static readers located at said one or more fixed locations and said emergency egress census also comprises information entered at said readers at said one or more mobile locations, and wherein said emergency egress census is variously displayed as the final functionality of the second function.

2. The ingress/emergency egress monitoring system of claim 1 wherein:

the first functional unit comprises a plurality of identification reader devices and a base computer, the second functional unit comprises a second computer; the third functional unit comprises static identification readers; and the fourth functional unit comprises mobile identification reader devices;

more specifically, wherein, said plurality of identification reader devices are located at points of ingress to a facility wherein each of said plurality of identification reader devices are is functionally connected said base computer; and wherein each of said plurality of identification reader devices continuously scores and collects individual, ingress identification information and communications said ingress information to said base computer and further wherein, under non-emergency conditions, each of said plurality of identification reader devices continuously scores individual egress information and communicates said egress information to said base computer;

and further, wherein said base computer generates a continuous facility occupancy census, adjusted for non-emergency egress from said facility, and transmits said occupancy census to said second computer, and further, wherein, under normal, non-emergency conditions, said base computer transmits a periodic normal operation signal to said second computer;

said second computer communicates through said system interface with said base computer and said first computer transmits said current facility occupancy census to said second computer, and said second maintains said current facility occupancy census; said second computer, initiates emergency response functions if said second computer fails to receive said periodic normal operations signal transmitted by said first computer;

said static identification reader devices are in functional communication with said second computer wherein said static identification reader devices register emergency egress information and transmit said egress information to said second computer;

said mobile identification reader devices are in functional communication with said second computer, wherein said mobile reader identification devices register and transmit emergency egress information to said second computer; and wherein said second computer continuously adjusts said facility occupancy census in response to egress information received from said static information reader devices and from said mobile information reader devices and displays said current facility occupancy census by hard copy and visual means.

3. An ingress/emergency egress monitoring system comprising:

head counting devices wherein said head counting devices are positioned at designated, normal entry point to a facility;

a computer wherein said computer is in both wireless and wired communication with each of said head counting devices, wherein, during normal ingress to a facility, each of said head counting devices counts individuals passing a point and periodically transmits to said computer said cumulative number of counts; wherein, said computer accumulates counts for each of said head counting device and periodically generates and displays a count census for each head counting device and said computer further generates a total head count census from data transmitted by all of said head counting devices;

an emergency evacuation head counting devices wherein said emergency evacuation head counting devices are positioned at designated, normal, exit points from said facility and further wherein said emergency evacuation head counting devices are positioned at designated emergency exits and still further wherein said emergency evacuation head counting devices are positioned at service and employee entry/exit locations; and wherein said computer is in wireless and wired communication with each of said emergency evacuation head counting devices positioned at said designated regular exits, at said designated emergency exits, and at said employee entry/exit locations; and finally, wherein egress counts, identified by location of said emergency evacuation counting device are transmitted to said computer wherein, during emergency conditions, said computer transmits a signal to activate all emergency evacuation head counting devices; each of said emergency evacuation head counting devices continuously counts the number of individuals passing through a specified egress point and periodically each of said emergency evacuation head counting devices transmits to said computer the cumulative number of individuals counted; wherein said computer accumulates said cumulative number from each of said emergency evacuation head counting devices and said computer periodically generates an egress census report for each of said emergency evacuation head counting devices and for total egress; and said computer also generates a period egress census comparing maximum ingress and current egress number to estimate the number of individuals remaining in said facility; and wherein, said ingress/emergency egress monitoring system further comprises at least one designated pair of emergency evacuation head counting devices wherein the first member of said at least one designated pair of emergency evacuation head counting devices is located and positioned in along a designated evacuation hall, passageway or corridor, and wherein the second member of said at least one designated pair of emergency evacuation head counting devices is located and positioned at a point along the same hall, passageway, or corridor as said first member of said at least one designated pair of emergency evacuation head counting devices at a distance from said first member of said pair of at least one designated pair of emergency evacuation head counting devices, wherein said point at which said second member of said at least one designated pair of emergency evacuation head counting devices is located is relatively closer to a point of final egress from said facility than the location of said first member of said at least one designated pair of emergency evacuation head counting devices; and further wherein each member of said at least one designated pair of emergency egress head counting devices is in wireless and wired communication with said computer; further wherein under emergency conditions said first member of said at least one designated pair of emergency evacuation head counting devices counts the number of individuals passing a first point during a given duration of time and said first member of said at least one designated pair of emergency evacuation head counting devices transmits said number to said computer, and wherein said second member of said at least one designated pair of emergency evacuation head counting devices for the same duration of time as said first member of said at least one designated pair of emergency evacuation head counting devices counts the number of individuals passing a second point at a time after said first member of said at least one designated pair of emergency evacuation head counting devices has transmitted count data to said computer, wherein said computer generates and displays rate of egress along the hall, pathway, or corridor wherein said members of said at least one designated pair of emergency evacuation head counting devices are positioned;

said ingress/emergency egress monitoring system further comprises at least one video cameras mounted in proximity to said both members said at least one designated pair of emergency evacuation head counting devices in said evacuation hall passageway or corridor wherein both members of said at least one designated pair of emergency evacuation head counting devices are positioned; said ingress/emergency egress monitoring system further comprises a two-way voice communication device, wherein said two-way voice communication device is positioned with each of said at least one video cameras, and further wherein said at least one video camera and said voice communication device are in functional and operational wireless and wired communication with said computer; wherein under emergency conditions, said computer transmits an activation signal to said video camera and an activation signal to said two-way voice communication device, wherein said video camera transmits real-time images to a display screen, and wherein said two-way radio communication device establishes voice communications with said computer.

4. The ingress/emergency egress monitoring system of claim 3 wherein said counting devices recognize physiognomic traits and transmit physiognomic trait information to said computer wherein said computer maintains an ingress census of individuals base on physiognomic information and wherein in under emergency egress, said counting devices recognize physiognomic traits and transmit physiognomic information to said computer, wherein said computer generates a current census of emergency egress base of physiognomic information and further wherein said computer generates a comparative census of ingress versus egress based on physiognomic information to generate a census of based on physiognomic information of individuals safely egressed from said facility and of individuals not identified as safely egressed from the facility.

5. The ingress/emergency egress monitoring system of claim 4, wherein individual, physiognomic identification information is entered into a base file in said computer, such that ingress and emergency egress of identified individuals can be followed.

* * * * *